US006742656B2

(12) United States Patent
Watters et al.

(10) Patent No.: US 6,742,656 B2
(45) Date of Patent: Jun. 1, 2004

(54) COMMON CORRECT MEDIA SUMP AND WING TANK DESIGN

(75) Inventors: Larry A. Watters, Washington County, PA (US); Daniel S. Placha, Allegheny County, PA (US)

(73) Assignee: Sedgman, LLC, Pittsburgh, PA (US)

( * ) Notice: Subject to any disclaimer, the term of this patent is extended or adjusted under 35 U.S.C. 154(b) by 317 days.

(21) Appl. No.: 10/095,647

(22) Filed: Mar. 12, 2002

(65) Prior Publication Data

US 2003/0173267 A1 Sep. 18, 2003

(51) Int. Cl.[7] ..... B03B 9/00
(52) U.S. Cl. ..... 209/2; 209/17
(58) Field of Search ..... 209/2, 17

(56) References Cited

U.S. PATENT DOCUMENTS 2,701,641 A * 2/1955 Centinus Krijgsman ..... 209/17
3,031,074 A * 4/1962 Hirosaburo Osawa ..... 209/17
5,794,791 A * 8/1998 Kindig ..... 209/727
5,819,945 A * 10/1998 Laskowski et al. ..... 209/2

* cited by examiner

*Primary Examiner*—Donald P. Walsh
*Assistant Examiner*—Kaitlin Joerger
(74) *Attorney, Agent, or Firm*—Buchanan Ingersoll PC

(57) ABSTRACT

In a coal preparation plant which receives a raw coal feed and separates the raw coal into clean coal and refuse, an apparatus is provided for use therein. The inventive apparatus is a combined sump common to the heavy media vessel and heavy media cyclone circuits used for recirculating medium storage for the heavy media vessel circuit and mixing device, referred to as a wing tank, to proportionally combine intermediate sized raw coal feed particles with a slurry of media and water for feeding the heavy media cyclone circuit. The advantage of this combined system is the ability to use a common recirculating media for use in both the heavy media vessel and heavy media cyclone circuits, without sacrificing the ability to have different recirculating gravities for each separating circuit.

15 Claims, 2 Drawing Sheets

COMMON CORRECT MEDIA SUMP AND WING TANK DESIGN

FIELD OF THE INVENTION

The present invention is directed generally toward coal preparation plants and, more particularly, toward a new common correct media sump and wing tank apparatus for processing raw coal particles with a slurry of media and water.

BACKGROUND OF THE INVENTION

Coal preparation plants separate organic and non-organic solid particles by their specific gravities. The coal preparation plant receives a feed of raw mined coal, and separates the raw mined coal into clean coal and refuse. Coal preparation plants typically utilize two basic processing methods for separating raw coal from rock and varying proportions of striated rock and coal from the higher quality coal. These two processing methods include heavy media and water based separation methods. Heavy media separation, utilizing a slurry of media, e.g., magnetite or ferrosilicon and water, to separate the coal from the refuse according to their specific gravity of dry solids, is the most common separation process for larger size (Plus 1 mm–0.5 mm) particles. Whereas, water based separation processes are more commonly used for the "cleaning" of the finer sized particles, as that term is commonly understood in the coal processing art.

Coal preparation plants may incorporate one or two heavy medium circuits for processing coal with a bottom size ranging from 0.5 mm to 2.0 mm. Often two separate processing methods, or circuits, are employed, namely, heavy media vessel and heavy media cyclone circuits for cleaning the coarser and finer coal size fractions, respectively.

Plants using heavy media processing require a pre-sized (removal of undersized and/or oversized particles) circuit feed. Raw coal screens are generally used to pre-size the correct media feed, whereas deslime screens are used to pre-size the heavy media cyclone feed, although a single screen may be used to pre-size the feed for both unit operations.

The raw coal screen receives the raw coal feed particles and separates them into coarse and undersized raw coal. The coarse or larger sized particles discharged from the raw coal screen surface are directed by gravity to the heavy media vessel. The deslime screen receives the undersized raw coal from the raw coal screen and separates it into intermediate and finer sized fractions. The raw coal particles discharged from the screen surface of the deslime screen are directed to the heavy media cyclone feed circuit, while the finer sized particles passing through the deslime screen are fed to the fine coal section of the coal preparation plant.

Traditionally, each heavy media feed circuit retains its own medium for recirculation, and thus requires separate medium storage sumps. These separate storage sumps increase the overall size of the plant area requirements, and add to the cost of building the coal preparation plant.

The present invention is directed toward overcoming one or more of the above-mentioned problems.

SUMMARY OF THE INVENTION

In a coal preparation plant which receives a raw coal feed and separates the raw coal into clean coal and refuse, an apparatus is provided for use therein. The inventive apparatus is a combined sump common to the heavy media vessel and heavy media cyclone circuits used for storage of the recirculating medium for the heavy media vessel circuit and a mixing device, referred to as a wing tank, to proportionally combine intermediate sized raw coal feed particles with a slurry of media and water for feeding the heavy media cyclone circuit. The advantage of this combined system is the ability to use a common recirculating media for use in both the heavy media vessel and heavy media cyclone circuits, without sacrificing the ability to have different recirculating gravities for each separating circuit.

The commonality between the two chambers of the combined apparatus is connecting the overflow of the wing tank to the correct media feed sump. The inventive apparatus includes a wing tank with an inlet receiving the intermediate sized raw coal directly from a deslime screen and a slurry of media and water from the drain portion of an underpan of at least one media recovery screen (refuse screen and clean coal screen) and an outlet by which the mixture of intermediate sized raw coal and slurry exits the column. The wing tank mixes the intermediate sized raw coal and the slurry of media and water according to a select proportion, and it is then pumped to a heavy media cyclone separation circuit, or section, of the coal preparation plant.

The inventive apparatus also includes a storage and feeding device, i.e, correct media sump, for retaining and distributing, via a pump, the recirculating medium used for the correct media circuit. The correct media feed sump includes a open top inlet for collection of the slurry of media and water from the drain portion of an underpan of at least one media recovery screen (refuse screen and clean coal screen) and an outlet by which the medium exits the sump.

In one form of the inventive apparatus, the wing tank is located adjacent to, or integrally formed with, the correct media feed sump, such that an overflow from the wing tank discharges into the correct media feed sump. The overflow is created when wetted intermediate raw coal particles discharged from the deslime screen are fed into the wing tank displacing an equivalent volume of media contained within the wing tank.

First and second nuclear density gauges may be provided for measuring the specific gravities of both the mixture output by the wing tank and the medium output by the correct media feed sump. The signals generated by the nuclear density gauges are received by control circuitry that adjusts the addition of water to the outputs of both chambers. Specifically, a water source is connected to the outputs of the wing tank and correct media feed sump via at least two control valves. The control circuitry adjusts the control valves to add water from the water source to the output mixtures based upon the measured specific gravity value of each mixture contained within the respective discharge pipes.

In another form, the inventive apparatus includes first and second pumps for discharging the mixture of raw coal and medium from the wing tank and medium only from the correct media feed sump. Each of the pumps has a suction connected to the respective storage device and an output connected to an input of the respective heavy media separating device, namely, vessel and cyclone separating devices. The water source is preferably connected between the respective storage device and each of the pump suctions, while the nuclear density gauges are preferably provided between the pump output and the respective heavy media separating device input.

In a further form, the inventive apparatus may include an over dense media splitter box, at least one bleed box, and a common medium distribution box. Over dense media from a magnetic separator, which is used to recover magnetite from the effluent streams from both of the heavy media separating circuits, is collected and distributed to the two chambers of the common correct sump/wing tank via the over dense media splitter box. The over dense media splitter box preferably contains a pneumatically controlled actuator driven by a signal generated from the plant control circuitry.

The common medium distribution box receives the slurry of media and water from the drain portion of the underpan of at least one media recovery screen. The bleed box is used to remove extraneous amounts of non-magnetics and water from the recirculating medium in the common medium distribution box. A quantity of the recirculating medium is bled from the system proportional to the feed contaminants. The bleed box device preferably contains a pneumatically controlled actuator driven by a signal generated from the plant control circuitry.

In an alternate form, the common medium distribution box may be removed and the return media proportionally fed directly to the wing tank and the common correct media sump. In this alternate form, the bleed box can be fed by any other means containing correct or return media as will be appreciated by one of ordinary skill in the art.

A method of combining the medium requirements for two separate media separating devices is also provided. The method generally includes the steps of receiving, at a combined wing tank/correct media feed sump, a slurry of media and water from the drain portion of an underpan of at least one media recovery screen (refuse screen and clean coal screen), receiving sized raw coal directly from a deslime screen, and mixing the raw coal and slurry in the wing tank according to a select proportion having a select specific gravity, such that overflow from the wing tank is received directly by the common correct media sump.

In one form, the inventive method further includes the steps of measuring the specific gravities of the outputs of both the wing tank, containing the sized raw coal and slurry mixture, and the correct media feed sump, containing a medium of water and magnetite. Additional water is individually added to the output flows of each storage unit in response to the measured specific gravities of each stream to maintain the selected specific gravity in each respective stream. Two pumps may be provided, one for feeding the sized raw coal and slurry mixture from the wing tank to a heavy media cyclone separating device, and one for feeding the media from the correct media feed sump to the heavy media vessel separating device. The pumps are generally provided between the storage chamber outputs and the input of the respective heavy media separating device.

Two nuclear density gauges may be provided for measuring the specific gravities of each respective flow stream. In a preferred form, the specific gravity of each stream is measured downstream of the respective pump and upstream of the respective heavy media separating device. Water is preferably added to each stream flow, in response to the measured specfic gravity value, downstream of the respective medium storage device and upstream of the respective discharge pump.

In another form of the inventive method, the wing tank is located adjacent to, or integrally formed with, the correct media feed sump, such that the overflow from the wing tank discharges directly into the correct media feed sump.

It is an object of the present invention to:

remove the need for a separate heavy media cyclone feed sump in coal preparation plants;

provide the ability to use a common recirculating media for use in both the heavy media vessel and heavy media cyclone circuits, without sacrificing the ability to have different recirculating gravities in each separating device circuit; and provide a common apparatus for storage of the recirculating media and for mixing the raw coal particles and the slurry of media and water, while occupying minimal space in a coal preparation plant.

Other objects, aspects and advantageous of present invention can be obtained from a study of the specification, the drawings, and the appended claims.

DETAILED DESCRIPTION OF THE INVENTION

Figure 1:
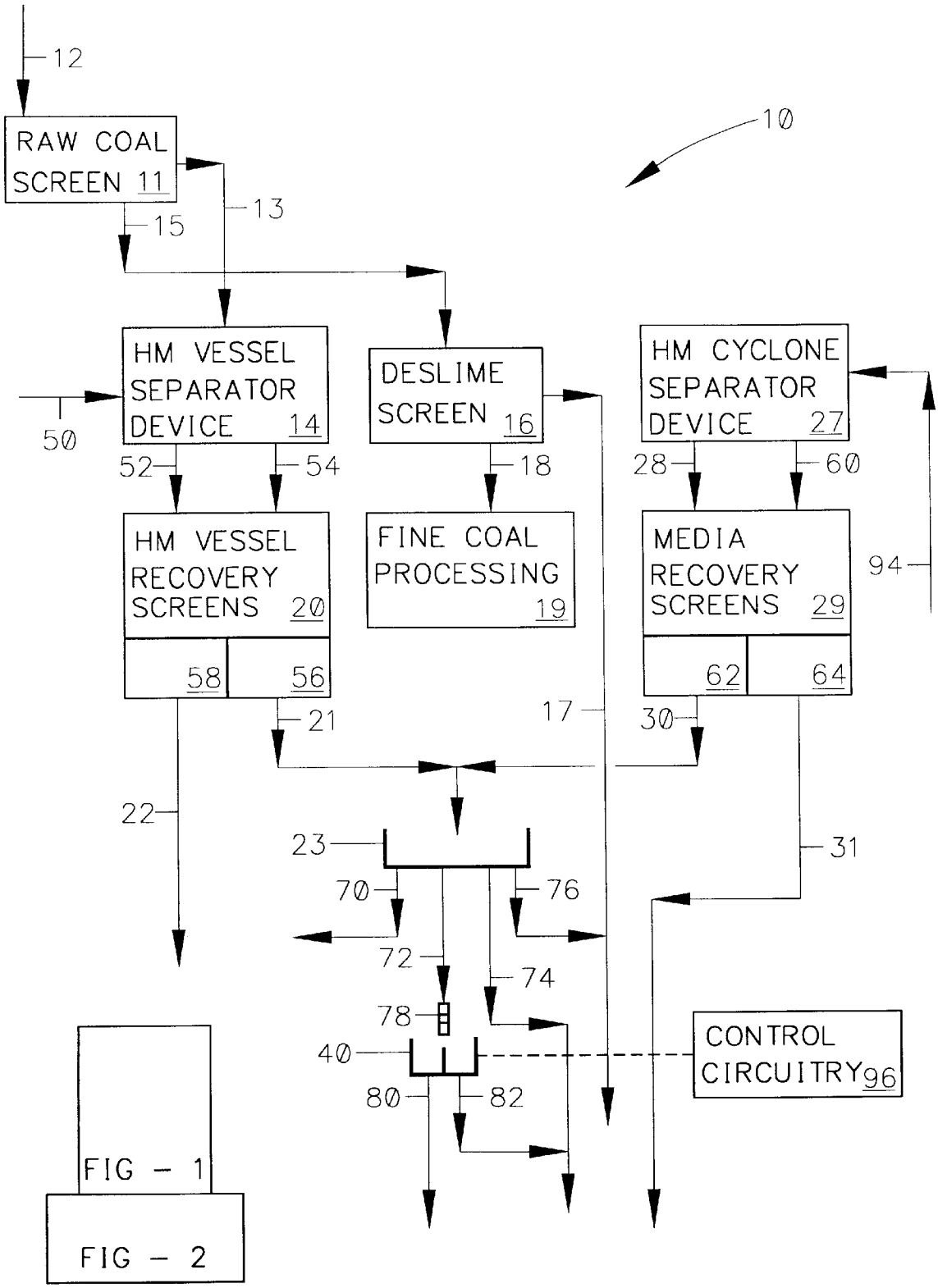
FIGS. 1–2 together are a block diagram of a coal preparation plant incorporating the inventive common correct media sump and wing tank design.
Figure 2:
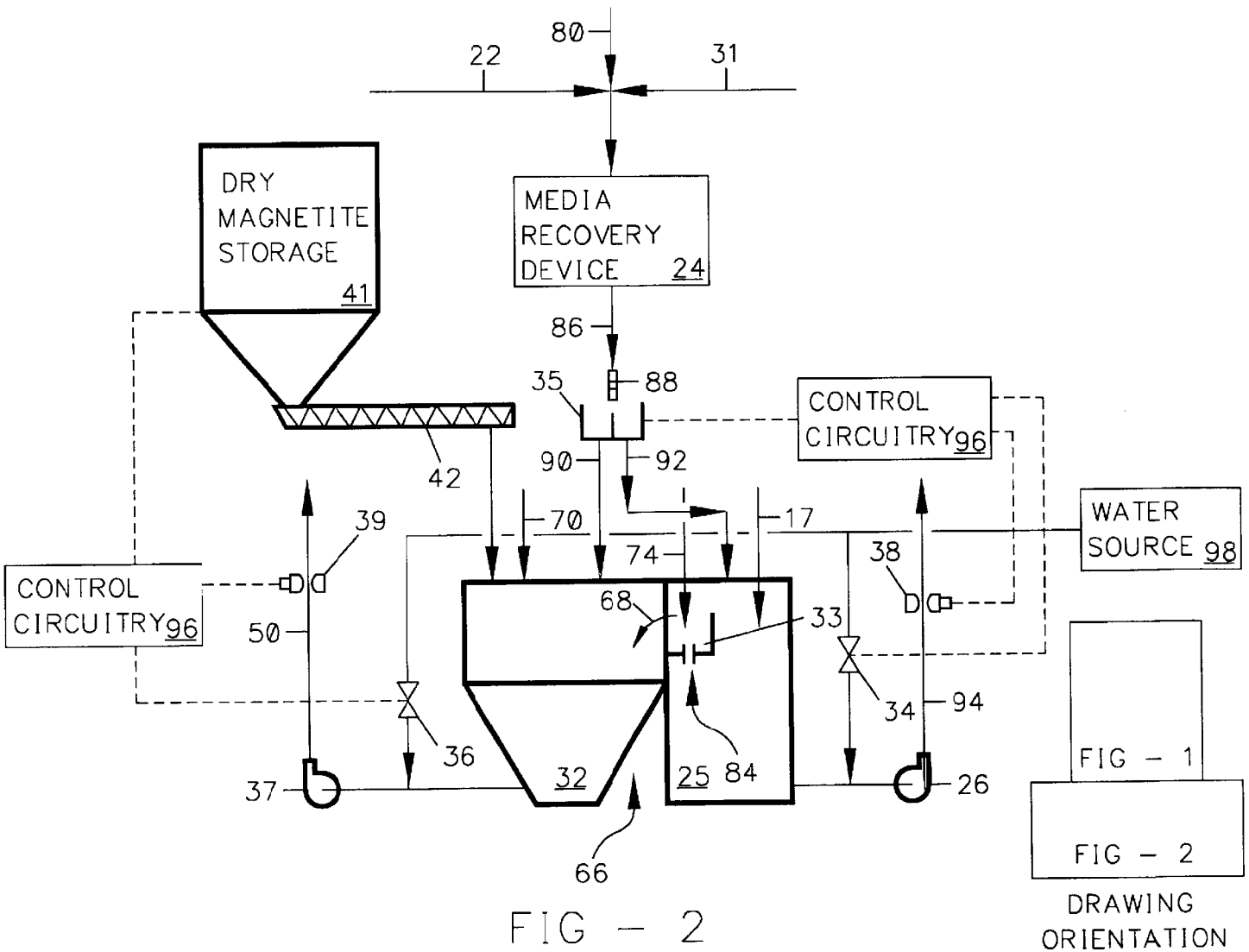

Referring to FIGS. 1–2, a block diagram of a common apparatus, shown generally at 66, is illustrated for the storage and distribution of recirculating media to two independent heavy media separation devices, or circuits, along with other components of a coal preparation plant, the coal preparation plant shown generally at 10. In order to better understand the inventive apparatus and method, the general operation of the coal preparation plant 10 when processing the coarser sized raw coal particles will be described.

The coal preparation plant 10 includes a raw coal screen assembly 11 receiving a raw coal feed 12 which includes both clean coal and refuse. The raw coal screen 11 conventionally separates the raw coal feed 12 into coarse 13 and finer 15 sized coal fractions. The coarse coal fraction 13, which is discharged from the raw coal screen deck as oversized coal, is gravity fed to a heavy media vessel 14. The finer sized coal fraction 15 is received in an underpan (not shown) of the raw coal screen 11 and fed to a deslime screen 16. The deslime screen 16 conventionally separates the finer size coal 15 from the raw coal screen 11 into intermediate sized coal 17 and fines 18. The fines 18 are directed to conventional fine coal processing circuitry 19 of the coal preparation plant 10.

The raw coal coarse size fraction 13, via gravity, and the vessel recirculating medium 50 (described in more detail hereafter), via a pump 37, are fed to the heavy media vessel 14. The heavy media vessel 14 conventionally separates the raw coal 13 into clean coal 52 and refuse 54, with each reporting to media recovery screens 20, typically of the vibratory type. The media recovery screens 20 include clean coal and refuse media recovery screens having drain 56 and rinse 58 sections. The majority of the magnetite, or ferrosilicon, used in the separation process will be recovered from the refuse 54 and coal 52 particles in the drain section 56 of the media recovery screens 20. Magnetite that has not passed through the media recovery screens 20 to the drain section 56 will be rinsed off of the respective clean coal/refuse particles and received in the rinse section 58 of the medium recovery screens 20. The drain section medium 21 is directed to a common medium distribution box 23, and the rinse section dilute medium 22 is fed to a magnetic separator media recovery device 24.

The raw coal particles 17 screened by the deslime screen 16 are received directly at the coal inlet of a wing tank 25. These raw coal particles 17 are mixed with a slurry of media and water in the wing tank 25 to form a raw coal slurry 94.

The raw coal slurry 94 is fed, via a pump 26, to a heavy media cyclone separating device 27 which utilizes conventional coal processing techniques to produce clean coal 28 and refuse 60. The clean coal particles 28 and refuse particles 60 are individually fed to vibratory media recovery screens 29. The media recovery screens 29 include clean coal and refuse media recovery screens having drain 62 and rinse 64 sections.

Since magnetite is typically utilized as the media by the heavy media separating device 27 for separating the clean coal 28 from the refuse 60, the clean coal 28 and refuse 60 particles passing over the media recovery screens 29 will both include particles of magnetite thereon. The majority of the magnetite will be removed from the refuse 60 and coal 28 particles in the drain section 62 of the media recovery screens 29. Magnetite that has not passed through the media recovery screens 29 to the drain section 62 will be rinsed off of the respective clean coal/refuse particles and received in the rinse section 64 of the medium recovery screens 29. The drain section medium 30 is directed to the common medium distribution box 23, while the rinse section dilute medium 31 is fed to the magnetic separator media recovery device 24.

The clean coal particles screened by the media recovery screens 20 and 29 are passed to conventional clean coal handling section(s) (not shown) of the coal preparation plant 10, while the refuse particles screened by the media recovery screens 20 and 29 are passed to conventional refuse handling section(s) (not shown) of the coal preparation plant 10.

The media 21 and 30 received by the distribution box 23 is proportionally fed to the wing tank 25 and a correct media feed sump 32. It should be noted, however, that the distribution box 23 shown in FIG. 1 may be removed and the return media 21 and 30 may be proportionally fed directly to the wing tank 25 and the correct media feed sump 32, without departing from the spirit and scope of the present invention. In this embodiment, the bleed box 40 can be fed by any other means containing correct or return media as will be appreciated by one of ordinary skill in the art.

The wing tank 25 and correct media feed sump 32 are integrally formed, or common to one another, such that the overflow from the wing tank 25 flows into the correct media feed sump 32. The combined wing tank 25 and correct media sump 32 design, such that the overflow from the wing tank 25 is received in the correct media sump 32, constitutes the inventive apparatus, shown generally at 66.

Since the amount of medium and coal fed to the wing tank 25 will exceed the total volume discharged by the heavy media cyclone feed pump 26, an overflow condition exists, shown by arrow 68, from the wing tank 25 to the correct media feed sump 32 The medium returned to the wing tank 25 is also split such that approximately fifty-percent of the total wing tank medium is fed to the central column of the wing tank 25 and fifty-percent to an overflow chamber 33. The remainder of the recirculating medium from the distribution box 23 is directed to the correct media feed sump 32. The distribution of media from the distribution box 23 is described below.

The distribution box 23 conventionally separates the media received therein into four media flows 70, 72, 74 and 76. The media flow 70 from the distribution box 23 is fed to the correct media sump 32. The media flow 72 from the distribution box 23 is fed to a bleed box 40 through a conventional hand switch 78. The bleed box 40 conventionally separates the media into two media flows 80 and 82. The bleed box 40 is preferably an elephant trunk distribution box, however, other types of distribution boxes may be utilized for the bleed box 40 without departing from the spirit and scope of the present invention.

The media flow 80 from the bleed box 40 is combined with the rinse section dilute mediums 22 and 31 and fed to the media recovery device 24. The media flow 82 from the bleed box 40 is combined with the media flow 74 from the distribution box 23 and is fed to the overflow chamber 33 of the wing tank 25. The overflow chamber 33 includes an orifice plate 84, and any of the media that does not flow through the orifice plate 84 and into the wing tank 25 overflows to the correct media sump 32. The media flow 76 from the distribution box 23 is mixed with the raw coal particles 17 from the deslime screen 16, with the slurry of coal, media and water received at the coal inlet of the wing tank 25.

The media recovery device 24 recovers over dense media 86 from the received media flows, and outputs the over dense media 86 to an over dense media splitter box 35 through a hand switch 88. The over dense media splitter box 35 is similar in construction to the bleed box 40 and conventionally separates the over dense media 86 into two over dense media flows 90 and 92. The over dense media flow 90 from the splitter box 35 is fed to the correct media sump 32, while the over dense media flow 92 from the splitter box 35 is fed to the wing tank 25.

The specific gravity of the raw coal slurry 94 feeding the heavy media cyclone 27 is measured by a nuclear density gauge 38. The nuclear density gauge 38 generates a signal representative of the measured specific gravity value, which is received by plant control circuitry 96. The plant control circuitry 96, in response to the measured specific gravity value, conventionally controls a make-up water control valve 34 to proportionally add water from a water source 98 to the suction piping of the heavy media cyclone feed pump 26 to maintain the specific gravity of the raw coal slurry 94 to a selected point. In addition, the control circuitry 96 conventionally controls the over dense media splitter box 35, which receives over dense media recovered by the magnetic separator 24, to proportionally add a portion of the over dense media received in the over dense media splitter box 35, via over dense media flow 92, to the wing tank 25 to aid in maintaining the specific gravity of the raw coal slurry 94 to the selected point.

Similarly, the specific gravity of the recirculating medium 50 fed to the heavy media vessel 14 is measured by a nuclear density gauge 39. The nuclear density gauge 39 generates a signal representative of the measured specific gravity value which is received by the plant control circuitry 96. The control circuitry 96, in response to the measured specific gravity value, conventionally controls a make-up water control valve 36 to proportionally add water from the water source 98 to the suction piping of the correct media feed pump 37 to maintain the specific gravity of the recirculating medium 50 to a selected point. Additionally, the control circuitry 96 conventionally controls the over dense media splitter box 35 to direct the remaining portion of over dense media, via over dense media flow 90, from the over dense media splitter box 35 to the correct media feed sump 32 to aid in maintaining the specific gravity of the recirculating medium 50 to the selected point.

If the specific gravity of the recirculating medium 50 is still too low, the control circuitry 96 conventionally controls the bleed box 40 to bleed additional medium at media flow 80 to the media recovery device 24 to add additional medium to the recirculating medium 50 to maintain its specific gravity at the selected point. A conventional level sensing device (not shown), which is part of the plant control circuitry 96, monitors the level in the correct media sump 32. If the level in the correct media feed sump 32 falls too low, then additional dry magnetite is added from a dry magnetite storage bin 41, via a screw conveyor 42, to the correct media feed sump 32, as controlled by the level sensing device.

While the present invention has been described with particular reference to the drawings, it should be understood that various modifications could be made without departing from the spirit and scope of the present invention. For example, while the correct media sump and wing tank are shown in the drawing as being integrally formed, they may also be connected via chutework such that the overflow from the wing tank is received by the correct media sump. Further, the inventive correct media sump and wing tank design may be utilized in preparation plants for ore and minerals other than coal, using separation media other than magnetite or ferrosilicon, without departing from the spirit and scope of the present invention.

We claim:

1. In a mineral preparation plant receiving a raw mineral feed and separating the raw mineral feed into clean mineral and refuse, an apparatus for mixing the raw mineral feed particles with a slurry of media and water, said apparatus comprising:

a wing tank receiving intermediate sized raw mineral directly from a deslime screen and a slurry of media and water from a drain portion of an underpan of at least one media recovery screen and outputting a mixture of intermediate sized raw mineral and slurry; and a correct media sump receiving a slurry of media and water from a drain portion of an underpan of at least one media recovery screen and outputting a flow of recirculating media, wherein overflow from the wing tank discharges into the correct media sump.

2. The apparatus of claim 1, wherein the mineral comprises coal, and wherein the media comprises magnetite or ferrosilicon.

3. The apparatus of claim 1, wherein the wing tank is integrally formed with the correct media sump, such that the overflow from the wing tank falls directly into the correct media sump.

4. The apparatus of claim 1, wherein the mixture of intermediate sized raw mineral and slurry from the wing tank is received at a heavy media cyclone separating circuit, and wherein the flow of recirculating media from the correct media sump is received at a heavy media vessel separating circuit, said apparatus further comprising:

a first nuclear density gauge measuring the specific gravity of the mixture output by the wing tank; and a second nuclear density gauge measuring the specific gravity of the recirculating media output by the correct media sump, wherein the first and second nuclear density gauges are configured to add water to the output mixture and recirculating media, respectively, to maintain the output mixture and recirculating media at select specific gravities.

5. The apparatus of claim 4, further comprising a water source connected to the wing tank output via a first valve, and connected to the correct media sump via a second valve, wherein the first and second nuclear density gauges control the first and second valves, respectively, to add water from the water source to the output mixture and recirculating media, respectively, based upon the measured specific gravity values.

6. The apparatus of claim 5, further comprising a first pump for pumping the wing tank output mixture to the heavy media cyclone separating device, and a second pump for pumping the correct media sump recirculating media to the heavy media vessel separating device, the first pump having a suction connected to the wing tank output and an output connected to an input of the heavy media cyclone separating device, the second pump having a suction connected to the correct media sump output and an output connected to an input of the heavy media vessel separating device, wherein the water source is connected between the wing tank output and the first pump suction head, and between the correct media sump output and the second pump section head, wherein the first nuclear density gauge is provided between the first pump output head and the heavy media cyclone separating device input, and wherein the second nuclear density gauge is provided between the second pump output head and the heavy media vessel separating device input.

7. The apparatus of claim 1, further comprising:

a common medium distribution box receiving the slurry of media and water from the drain portion of the underpan of the at least one media recovery screen and distributing the received slurry to the wing tank and correct media sump; and a bleed box bleeding off a portion of the received slurry from the common medium distribution box.

8. The apparatus of claim 7, further comprising:

a media recovery device receiving a portion of the bled slurry from the bleed box and a slurry of media and water from a rinse portion of the underpan of the at least one media recovery screen and outputting media recovered therefrom; and an over dense media splitter box receiving the recovered media from the media recovery device and proportionally distributing the recovered media to the wing tank and correct media sump.

9. A method of combining media requirements for two separate media separating devices, said method of comprising the steps of:

receiving, at a combined wing tank/correct media feed sump, a slurry of media and water from a drain portion of an underpan of at least one media recovery screen;

receiving, at the wing tank, sized raw mineral from a deslime screen;

mixing the raw mineral and slurry in the wing tank according to a select proportion having a select specific gravity, such that overflow from the wing tank is received by the correct media sump;

outputting the wing tank mixture to a heavy media cyclone separating device;

outputting, as recirculating media, the media slurry in the correct media sump to a heavy media vessel separating device; and maintaining the output mixture and recirculating media at select specific gravities.

10. The method of claim 9, further comprising the steps of:

measuring the specific gravities of the output mixture and recirculating media; and adding water to the respective mixture and recirculating media in response to the measured specific gravity values to maintain the respective mixture and recirculating media at the respective select specific gravities.

11. The method of claim 10, further comprising the steps of:

providing a first pump for pumping the mixture from the wing tank to the heavy media cyclone separating device, the first pump provided between the wing tank output and the havy media cyclone separating device input; and providing a second pump for pumping the recirculating media from the correct media sump to the heavy media vessel separating device, the second pump provided between the correct media sump output and the heavy media vessel separating device input.

12. The method of claim 11, wherein the measuring step comprises the steps of:

measuring the specific gravity of the mixture from the wing tank downstream of the first pump and upstream of the heavy media cyclone separating device; and measuring the specific gravity of the recirculating media from the correct media sump downstream of the second pump and upstream of the heavy media vessel separating device.

13. The method of claim 11, wherein the adding step comprises the steps of:

adding water to the wing tank mixture upstream of the first pump and downstream of the wing tank; and adding water to the recirculating media upstream of the second pump and downstream of the correct media sump.

14. The method of claim 9, wherein the mineral comprises coal, and wherein the media comprises magnetite or ferrosilicon.

15. The method of claim 9, wherein the wing tank is integrally formed with the correct media sump, such that overflow from the wing tank falls directly into the correct media sump.

* * * * *